United States Patent [19]

Ball

[11] 4,323,291

[45] Apr. 6, 1982

[54] DESK OR THE LIKE WITH WIRE MANAGEMENT

[75] Inventor: Douglas C. Ball, Quebec, Canada

[73] Assignee: Hauserman Ltd., Waterloo, Canada

[21] Appl. No.: 46,779

[22] Filed: Jun. 8, 1979

[51] Int. Cl.[3] ..... A47B 17/00; A47B 13/02

[52] U.S. Cl. ..... 312/194; 312/195; 312/196; 312/223; 108/150

[58] Field of Search ..... 312/196, 195, 194, 223, 312/293; 108/23, 150

[56] References Cited

U.S. PATENT DOCUMENTS

| | | | |
|---|---|---|---|
| 1,786,823 | 12/1930 | Carrington et al. | 312/194 |
| 2,014,329 | 9/1935 | Hellmann | 312/223 |
| 2,306,209 | 12/1942 | Elofson et al. | 312/196 |
| 2,563,747 | 8/1951 | Ressinger | 312/223 |
| 3,000,682 | 9/1961 | Loew et al. | 312/194 |
| 3,058,794 | 10/1962 | Barber | 312/194 |
| 3,471,947 | 10/1969 | Genser | 312/196 |
| 3,635,174 | 1/1972 | Ball et al. | 312/194 |
| 3,770,334 | 11/1973 | Weber | 312/196 |
| 3,783,175 | 1/1974 | Timmons | 312/223 |
| 3,883,202 | 5/1975 | Konig | 312/195 |
| 3,922,045 | 11/1975 | Meyer | 312/195 |
| 4,013,880 | 3/1977 | Kennedy, Jr. et al. | 312/223 |
| 4,050,752 | 9/1977 | Dykstra | 312/195 |
| 4,066,305 | 1/1978 | Gazarek | 312/195 |
| 4,094,561 | 6/1978 | Wolff et al. | 312/223 |
| 4,163,867 | 8/1979 | Breidenbach | 312/223 |

*Primary Examiner*—Victor N. Sakran

*Attorney, Agent, or Firm*—Maky, Renner, Otto & Boisselle

[57] ABSTRACT

A desk or like unit with full duct internal wire management includes rectangular horizontal top and vertical wood support panels therefor, and longitudinally aligned elongate enclosure brackets cooperating with the wood panels to form an elongate horizontal wiring duct or ducts extending the length or width of the desk, or both, for hidden storage of wires or the like. The top panel has an elongate access opening therein extending co-extensively with the wiring duct to facilitate handling and feeding of wires therein, and a removable snap-in closure receivable in such access opening normally closes the same. The closure, which is so profiled to form a continuation of the top surface of the desk, includes a number of notches at selected positions therealong for egress of wires from the wiring duct to the top surface of the top panel for connection to an appliance supported thereon. The desk may be readily integrated in modern office systems, the vertical panels having openings coaxial with the ends of the wiring duct for passage of wires into the wiring duct from raceways in wall panels or juxtaposed desks or the like, and the elongate enclosure brackets having openings or apertures therein for passage of wires into the wiring duct from the interior of the desk, from the floor or for providing communication between transversely extending ducts.

33 Claims, 10 Drawing Figures

DESK OR THE LIKE WITH WIRE MANAGEMENT

FIELD OF THE INVENTION

This invention relates generally to desks or like units such as are employed in offices, and more particularly to desks or like units with full duct internal wire management. For purposes of this disclosure, reference to desks or like units is intended to include articles of manufacture such as desks, credenzas and enclosure units. In addition, any reference to wires, wire management, wiring ducts, etc., is intended to refer generally to connecting elements such as wires, cords, air tubes and cables, management of such connecting elements, and ducts therefor, respectively, that desirably could be installed or incorporated in such desks or like units. Moreover, for purposes of the following description, horizontal, horizontally, vertical, vertically, normal, and perpendicular, are intended to encompass, respectively, horizontal and substantially horizontal, horizontally and substantially horizontally, and so on, unless otherwise specifically stated.

BACKGROUND OF THE INVENTION

Many appliances used in modern offices, e.g., telephones, typewriters, calculators, computer terminals and dictation equipment, are positioned on desks or like units for convenient use. Such appliances require electrical power and/or interconnection with other appliances; and accordingly, each appliance has wires or other connecting elements. Such wires or connecting elements when strewn over the desk may detract from the functionality and appearance of the desk, and additionally may create a safety problem. Efforts have been made to position the wires or like connecting elements internally of the desk structure for functional, appearance and safety purposes. Representative examples of known desk structures having interior wire management capability are shown and described in the following U.S. Pat. Nos. 1,786,823 to Carrington et al, 3,000,682 to Loew et al, 3,635,174 to applicant, and 3,883,202 to Koenig.

SUMMARY OF THE INVENTION

In contradistinction to known desk constructions, a desk or like unit according to this invention includes a horizontal top panel and at least one vertical panel positioned beneath the top panel to extend along an edge thereof. Together such panels form a corner at which is secured an elongate enclosure bracket or brackets which cooperate with such panels to form an elongate horizontal wiring duct running along the edge of the top panel.

According to one form of the invention, the bracket, which are of L-shape transverse cross-section, have mounting flanges at the distal ends of horizontal and vertical legs thereof for securing the bracket to the panels. One mounting flange is received in a slot formed by a mounting strip secured to the underside of the top panel while the other mounting flange includes longitudinally spaced openings for receipt of fasteners to secure the enclosure to the vertical panel. Preferably, a number of such brackets of like cross-sectional shape are longitudinally aligned to define the elongate wiring duct which may extend the length and/or width of the desk. Such construction provides for quick and easy attachment or removal of the enclosure brackets.

Another feature of the invention is the provision of an elongate peripheral access opening in the top panel extending coextensively with the wiring duct and a removable snap-in closure therefor receivable in such access opening normally to close the same and to form a continuation of the top surface of the top panel. The closure includes a number of notches at selected positions therealong for wire egress from the wiring duct to the top surface of the top panel for connection to an appliance or appliances supported thereon. With such construction, the wires may be presented at the top surface of the desk at any one of a plurality of locations along the length or width thereof to allow for positioning of the appliance or appliances anywhere on the desk top surface with a minimal length of the wire being exposed. Moreover, the closure forms a continuation of the top surface thereby increasing the amount of unable desk top surface than otherwise would be available. In addition, with the closure removed, threading or handling of wires in the wiring duct may be quickly and conveniently accomplished through the access opening without requiring disassembly of the desk, and the closure may be snapped in place after the wires have been, for example, connected to the appliance supported on the top panel.

Access to the duct for ingress of wires may be had through openings in vertical side panels coaxial with the ends of the wire duct, and snap-in end closures are normally received in such openings partially to close the same. Such end closures may be snapped in place after the wires have been threaded through the openings in the vertical side panels. In addition, the legs of the L-shape brackets may have a slot or slots therein for passage of wires from the interior of the desk, such as those wires extending upwardly from the floor. Accordingly, the desk is readily adaptable for use in modern office landscapes wherein wiring accommodations are provided at desk level such as in panel raceways or at the floor.

In view of the foregoing, a principal object of the present invention is the provision of a desk of improved functionality and safety, of simple construction and which is aesthetically pleasing.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 9 is a fragmentary isometic illustration of an upper forward portion of still another form of desk unit with portions thereof broken away; and FIG. 10 is a fragmentary isometic illustration of an upper rear portion of a credenza unit with portions thereof broken away.

DESCRIPTION OF THE PREFERRED EMBODIMENTS

Figure 1:
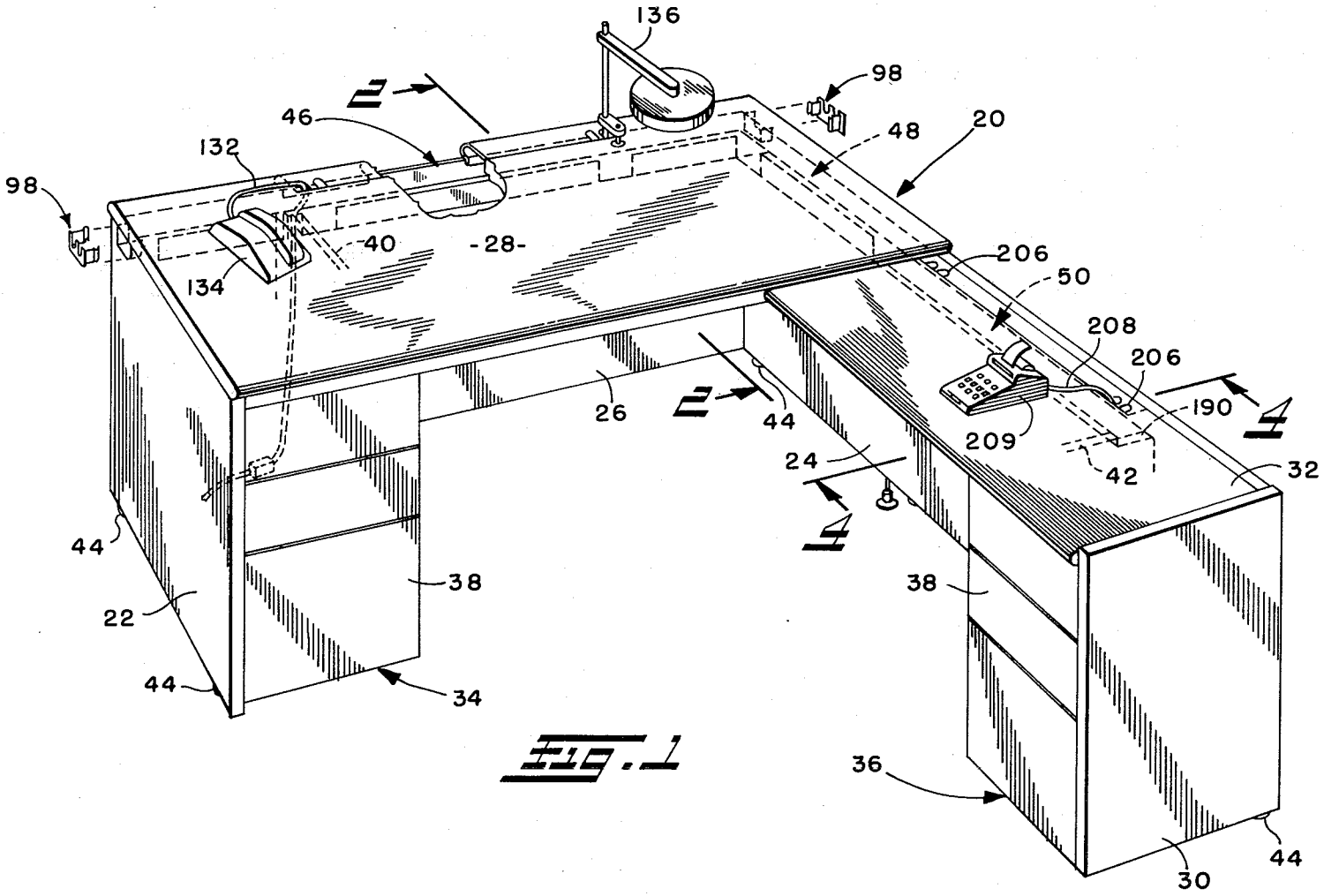
FIG. 1 is an isometric illustration of an L-shape desk unit constructed in accordance with the present invention as viewed from above and to the rear thereof, with a portion of the desk broken away.

Referring now to the drawing, wherein the drawings are for the purpose of illustrating preferred embodiments of the invention only and not for purposes of limiting same, FIG. 1 shows a preferred form of desk unit 20, constructed according to the invention, which is characterized by a combined desk portion and run-off portion arranged generally in the shape of an "L". The main structural components of desk unit 20 include vertical side panels 22 and 24 and vertical front panel 26 which together support on their top edges horizontal desk top panel 28. The side panel 24 extends rearwardly beyond the desk top panel 28 and supports along with vertical end panel 30 a horizontal run-off top panel 32. Provided inwardly of the side panel 22 and end panel 30 are desk pedestals 34 and 36, respectively, which include compartments for drawers 38 or the like. The drawer space of pedestal 34 is enclosed at the top and sides thereof by the desk top panel 28, side panel 22, front panel 26 and a vertical inner pedestal panel 40. The other pedestal 36 is similarly enclosed by run-off top panel 32, side panel 24, end panel 30 and a vertical inner pedestal panel 42.

The panels shown are generally rectangular in shape and are secured together at their respective abutting edges by suitable means. The panels may be formed of any suitable material, but preferably are made of wood. For cost and appearance purposes, the wood panels may comprise as the core thereof, a low cost board, plywood, particle board, etc., which core is veneered with a suitable decorative covering to simulate solid wood.

The vertical side panels 22 and 24 and front panel 26 may extend downwardly from the desk top panel 28 to the floor and may have secured at their bottom edges floor slides or levelers 44 or the like. As shown, the side edge surfaces of the desk top panel 28 are flush with the outer surfaces of the side panels 22 and 24 while the front edge of the desk top panel may project slightly beyond the outer surface of the front panel 26. The front and rear edges of the desk top panel 28 may be rounded or bull nosed. In contrast, the top surface of the run-off top panel 32 may be flush with (as shown) or lower than the top edge surface of the side panel 24 and end panel 30 so that the same is disposed in a lower horizontal plane than that of the desk top panel 28 as is often preferred in desks similar to that described.

Such a desk construction as above described presents a clean, uncluttered appearance which is pleasing to the eye and functionally effective.

For wire management purposes, the desk unit 20 includes elongate peripheral front wiring duct 46, side wiring duct 48 and run-off wiring duct 50 interiorly of the desk body defined by the main structural panels. The front wiring duct 46 runs along the front peripheral edge of the desk top panel 28 while the side wiring duct 48 runs at right angles to the front wiring duct 46 along the side peripheral edge of the desk top panel 28. The run-off wiring duct 50 runs along the outer peripheral side edge of the run-off top panel 32 and is coaxial with the side wiring duct 48 thereby essentially forming a continuation thereof. The front and side wiring ducts may extend, respectively, the length and width of the desk while the run-off wiring duct may extend to the inner pedestal wall 42. With the foregoing arrangement, full duct internal wire management is provided for the desk unit.

Figure 2:
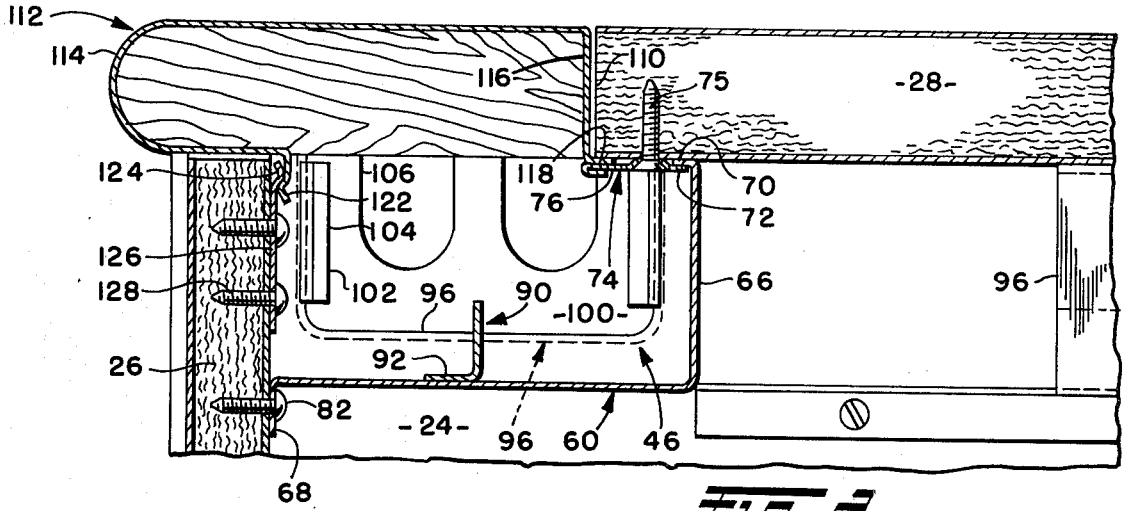
FIG. 2 is a fragmentary, cross-sectional, elevation through the upper portion of the desk unit of FIG. 1, taken along the line 2—2 thereof.
Figure 5:
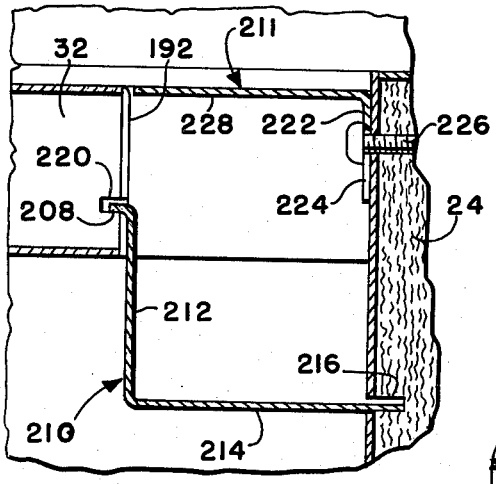
FIG. 5 is a fragmentary, cross-sectional, elevation through the upper, outer portion of a modified run-off portion of a desk unit similar to that of FIG. 1.
Figures 5, 7, 8:
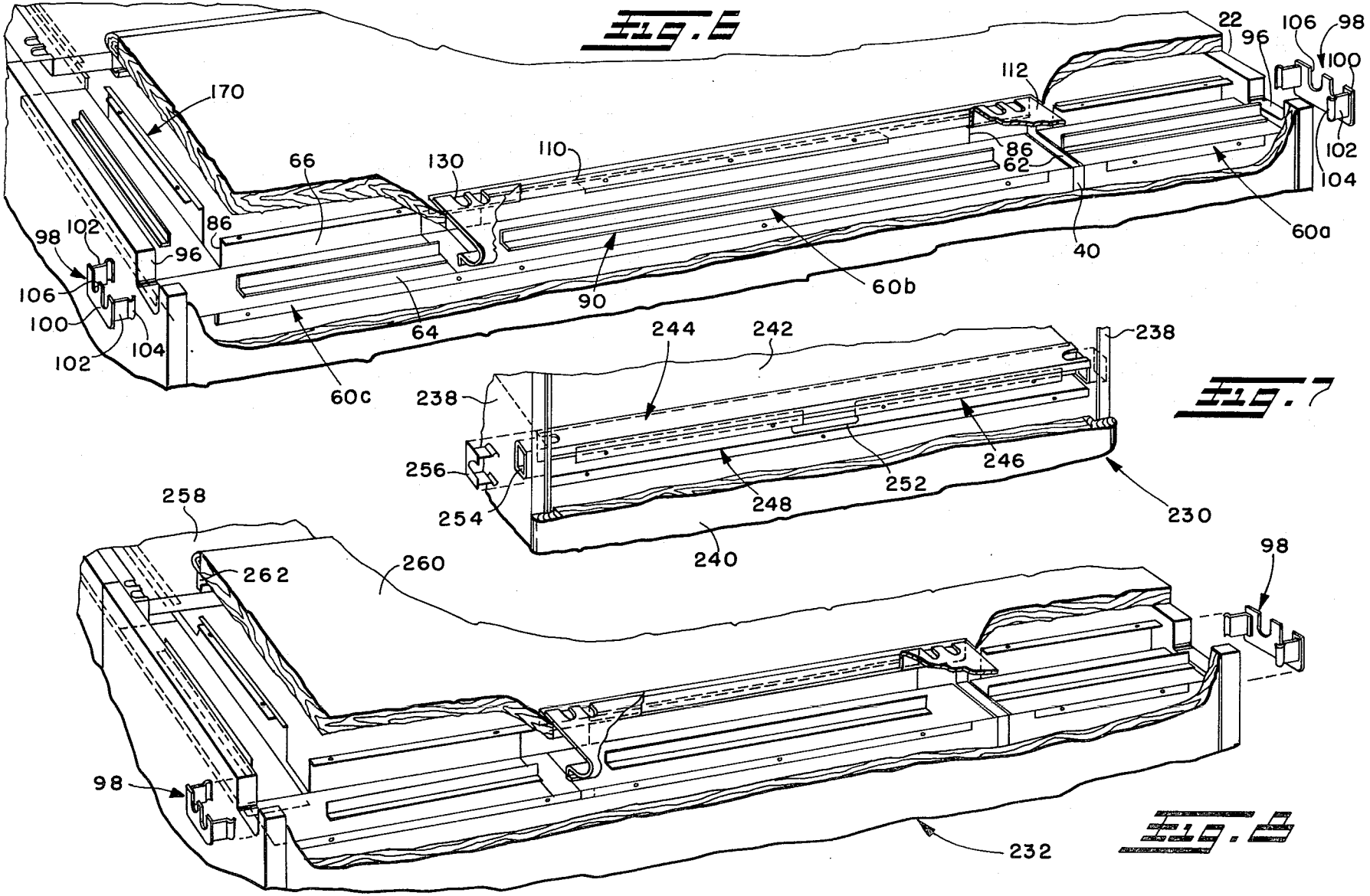
FIG. 7 is a fragmentary isometric illustration of a rear portion of an enclosure unit with portions thereof broken away.
FIG. 8 is a fragmentary isometric illustration of an upper forward portion of another form of desk unit with portions thereof broken away.
Figures 5, 6:
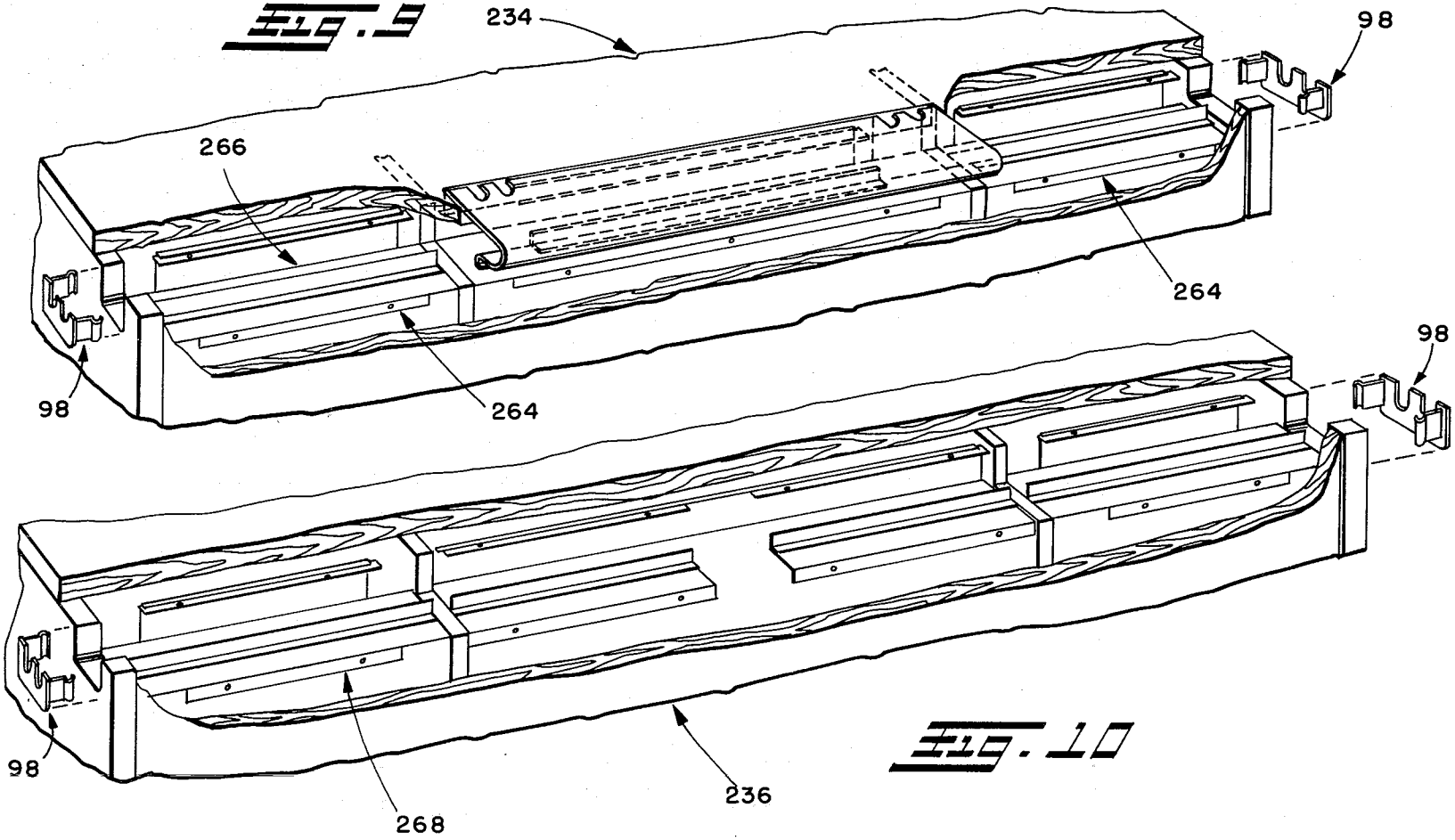
FIG 6 is a fragmentary isometric illustration of the upper forward portion of the desk unit of FIG. 1 with portions thereof broken away.

As best seen in FIGS. 2 and 6, the front wiring duct 46 may be formed at the interior corner of the mating front panel 26 and desk top panel 28 by a number of enclosure members or brackets 60 which are aligned and which together preferably extend the length of the desk from side panel 22 to side panel 24. The brackets 60 which are L-shape and of like cross-section cooperate with the wood structural panels to define the front wiring duct 46. As shown in FIG. 6, three such brackets 60*a*, 60*b* and 60*c* are provided. The bracket 60*a* may extend between side panel 22 and inner pedestal panel 40. The inner pedestal panel 40 is suitably notched at 62 to permit communication between the adjacent portions of the front wiring duct 46 defined by adjacent brackets 60*a* and 60*b*.

Preferably, longer legs 64 of the L-shape brackets run parallel to and are spaced from the desk top panel 28 while shorter legs 66 run parallel to and are spaced from the desk front panel 26 thereby forming a rectilinear elongate duct. The brackets 60 have terminal mounting flanges 68 and 70 at the distal ends of the legs 64 and 66, respectively, for securing the brackets to the panels. Mounting flange 70 extends forwardly towards front panel 26 and is adapted to be received in a slot formed by a rearwardly extending flange 72 of a mounting strip 74 secured to the under surface of the desk top panel 28 by screw fastener 75. The mounting strip 74 is positioned inwardly from and extends parallel to the front panel 26. The horizontal flange 72 is spaced slightly from the under surface of the desk top panel to form the slot for receipt of mounting flange 70. For a purpose which will become more apparent below, the mounting strip 74 also includes a forwardly extending flange 76 which is similarly spaced from the under surface of the desk top panel 28 to form a forwardly opening slot. For safety purposes, the distal or forward edge of the flange 76 is reversely folded so as not to present a sharp edge.

With the mounting flange 70 inserted in the slot formed by the spaced flange 72, the mounting flange 68, which extends downwardly perpendicular to the horizontal leg 64, will abut the vertical front panel 26. The mounting flange 68 has suitable longitudinally-spaced holes therethrough for receiving screw fasteners 82 which are threaded into suitable holes in the vertical front panel 26 thereby to secure the bracket 60 in place.

The described arrangement provides for quick and easy assembly of the front wiring duct 46 while securely attaching the brackets 60 to the desk structural panels.

For ingress of wires into the front wiring duct 46 from the interior of the desk, the brackets 60 may include one or more openings or apertures 86 seen best in FIG. 6. The apertures 86 may be in the vertical leg 66 at opposite ends of the brackets 60. In addition, elongate angles 90 are secured centrally to the horizontal legs 64 of the brackets. The angles are secured along one leg 92 thereof to the horizontal leg 64 of the bracket 60 so that the other leg 94 thereof extends vertically and divides the duct into two horizontally spaced portions. In many instances, it is necessary or desirable to separate wires in the wiring duct such as where one wire may tend to create interference in another.

Wires may also be received into the interior of the front wiring duct 46 through openings 96 provided in the side panels 24 and 26. The openings are coaxially aligned with the ends of the duct 46 and are preferably formed by notching the upper horizontal edge of the respective panels to a depth and width substantially corresponding to that of the wiring duct 46. Received in each opening 96 is a snap-in end closure 98 for partially closing the opening 96. Each end closure 98 includes a cover plate 100 and deformable arms 102 extending normal thereto. The arms 102 include at their distal ends opposed outwardly extending lips 104 which engage the interior surface of the side panels when the end closures are fully inserted into the side panel opening thereby to lock the same in place. When so inserted, the cover plate 100 will be substantially flush with the exposed outer surface of the side panels with the peripheral edges of the cover plate 100 slightly overlapping the outer surfaces of the side panels adjacent the openings 96 therein. It should be appreciated that with the end closures removed, insertion and threading of wires through the duct is facilitated. However, with the end closures in place, the cover plate includes upwardly opening notches 106 for ingress of wires therethrough. Preferably, the end closures are made of plastic.

It can now be appreciated that wiring may be received into the front wiring duct 46 either from the interior of the desk through apertures 86 or at desk level through openings 96 in the side panels at either end of the desk. Hence, either end of the desk may be aligned for example with a raceway in a panel or with the wiring duct of another desk or like unit positioned adjacent thereto. Also, wires may be received from receptacles in the floor beneath the desk unit through openings 96 in the brackets 60. While such wires may be readily so received, threading of the wires within the interior of the desk unit is facilitated by providing an access opening 110 in the desk top panel 28 of the desk unit.

The access opening 110 shown is in the form of an elongate cut-out in the front peripheral edge of the top panel 28. The access opening extends a substantial length centrally of the length of the desk top panel 28 and is coextensive with the front wiring duct 46. The access opening could, however, extend the full length of the desk unit. The access opening also preferably is of sufficient width to allow insertion of a hand into the front wiring duct 46 whereby wires may be easily layed therein and threaded through the ends thereof which are not exposed by the access opening.

The access opening 110 in the desk top panel 28 is normally closed by means of a removable closure 112. The closure 112 is in the form of a thin metal or plastic sheet having a central contoured portion 114 formed to simulate the edge profile of the adjacent portion of the top desk panel 28 thereby forming a continuation of the desk top panel. At the rear end or edge of the central portion 114, the closure includes a web 116 extending downwardly the thickness of the desk top panel. The web 116 terminates in a mounting flange 118 which extends perpendicular to and rearwardly from the web. The mounting flange 118 is adapted to fit into the space defined by the horizontal flange 76 of the mounting strip 74 which is secured to the desk top panel just inwardly of the access opening 110. The other end or edge of the closure 112 includes a downwardly extending snap flange 120 which terminates in a forwardly extending V-shape lip portion 122. The lip portion 122 is adapted to interlock with an oppositely formed lip 124 of latch plate 126 which extends horizontally adjacent the top edge of the front panel and is secured to the front panel 28 by fastener screws 128. With the mounting flange 118 inserted in the slot defined by the mounting strip flange 76, the closure 112 may be pivotally urged downwardly at its forward end whereby the snap flange 120 will be cammed over the lip 124 of the latch plate 126 thereby to interlock the same. Preferably, the snap flange 120 will bear against the latch plate 126 sufficiently to urge the closure 112 forwardly butting the web 116 of the closure against the edge surface of the desk top panel opening for a tight fit. When so positioned, the exposed outer surface of the closure will form a continuation of the upper top panel surface.

For egress of wires from the interior of the front wiring duct 46 to the top surface of the desk top panel 28, the closure 112 has a plurality of openings such as notches 130 desirably spaced along the length of the closure. As shown, two spaced notches 130 are provided at opposite ends of the closure and the notches 130 open rearwardly. Preferably, the web 116 of the closure 112 does not extend fully to the ends of the closure whereby the notches 130 are open ended. Thus, the wires may be withdrawn from the wiring duct to the top of the desk and the closure subsequently positioned in the access opening with the wires being received in the notches. For example, a cord such as that indicated by reference numeral 132 can thus be threaded through the notches 130 to the top surface of the desk top panel for connection to an appliance 134 supported thereon, as is illustrated in FIG. 1. It should also be appreciated that the clamp portion of a fixture such as light fixture 136 may be received in one of the notches 130 for attachment to the desk top panel 28 inwardly of its front edge.

Figure 3:
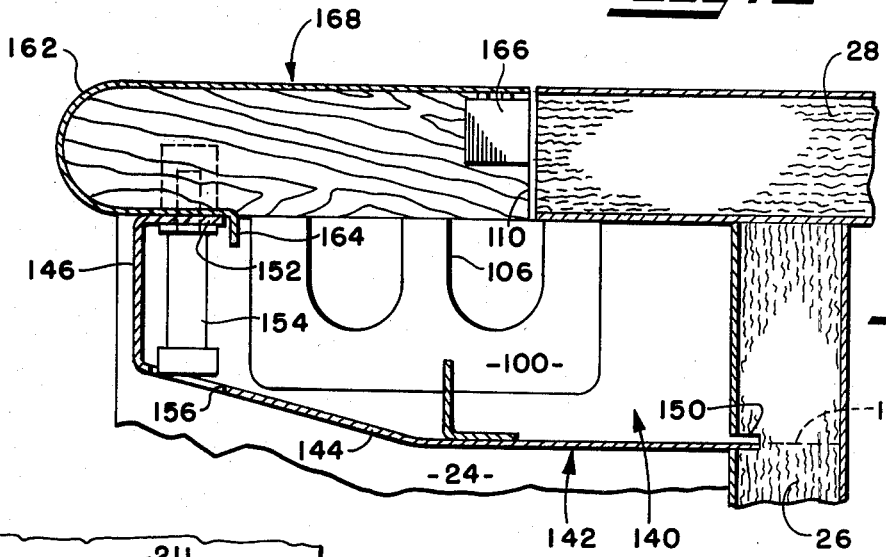
FIG. 3 is a fragmentary, cross-sectional, elevation through the upper portion of a modified desk unit similar to that of FIG. 1.

In FIG. 3, a modified front wiring duct 140 is shown for use with a desk unit wherein the front edge of the desk top panel 28 projects substantially beyond the outer surface of the front panel 28. Such modified duct 140 runs along the front edge of the desk top panel 28 and may be formed at the exterior corner of the mating front panel 26 and desk top panel 28 by at least one enclosure member or bracket 142. The bracket 142 which is J-shaped cooperates with the wood structural panels to define the front wiring duct 140 which preferably extends from side panel to side panel.

As shown, the long stem 144 of the J-shape bracket 142 runs substantially parallel to and is spaced from the desk top panel 28 while the bottom leg 146 thereof runs parallel to and is spaced from the front panel 26 thereby giving the duct 46 a substantially rectilinear cross-sectional shape. However, the long stem adjacent the vertical bottom leg 146 of the bracket may be inclined to horizontal with the distal portion of the long stem being at a lower elevation than the vertical leg 146 so that the bracket is less visible when viewed from the front and above the desk. The bracket 142 at the distal end of the long stem 144 thereof is receivable in a horizontally extending groove 150 in the outer face of the front panel 26. With the end of the long stem received in groove 150, the short stem 152 abuts the underside of the desk top panel 28 and is secured thereto by screw fasteners 154. Suitable access openings 156 are preferably provided in the long stem 144 and aligned with the openings in the short stem for the fasteners 154 to permit installation thereof.

For ingress of wires into the front wiring duct 46 from the interior of the desk unit, the front panel 26 may be notched at its upper horizontal edge to form one or more openings 158 therein along the length of the duct 46. Wires may also be received into the duct 46 through the ends thereof through notches in the side panels which may be partially closed by means of end closures in like manner to that described above.

Similar to the desk unit shown in FIGS. 1 and 2, egress of wires from the front wiring duct 46 to the top of the desk may be had through an access opening 110 in the desk top panel 28, which access opening 110 is normally closed by means of a modified removable closure 160. The closure 160 may be similar in construction to that described above and includes a central contoured portion 162 formed to simulate the edge profile of the adjacent portion of the top desk panel 28 thereby forming a continuation thereof. The forwardmost end or edge of the central portion terminates in a downwardly extending lip or flange 164 which overlies the distal end of the short stem 152 of bracket 142. The other end or edge of the central portion abuts the desk top at the access opening therein and the same is secured in place by means of a magnetic latch 166 which is so positioned that the central portion of the closure is flush with the top surface of the desk top panel.

Referring now to the side wiring duct 48, the same is formed by another enclosure member or bracket 170. As best shown in FIGS. 1 and 6, only one such bracket 170 is provided and the same is secured to the desk top panel 28 and side panel 24. Preferably, the bracket 170 is aligned with an aperture 86 in the bracket **60*c* thereby providing for communication between the front wiring duct 46 and side wiring duct 48 and extends from the bracket 60*c* to the rear edge of the desk top panel 28 where it is aligned with a run-off bracket 178 which forms the run-off wiring duct 48**.

Figure 4:
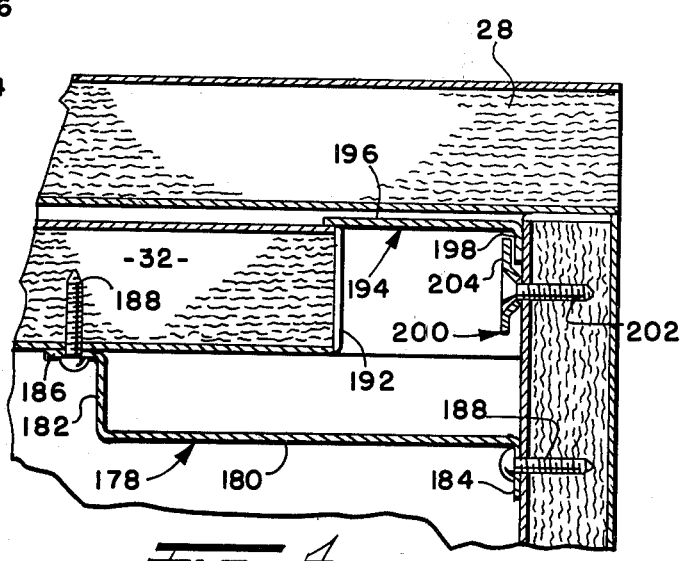
FIG. 4 is a fragmentary, cross-sectional, elevation showing the upper, outer portion of the run-off portion of the desk unit of FIG. 1, taken along the line 4—4 thereof.

As best shown in FIG. 4, the run-off bracket 178 is also L-shape with the horizontal leg 180 thereof aligned in the same plane as the horizontal leg of the bracket 170 forming the side wiring duct 48. Because the run-off top panel 32 is disposed in a lower horizontal plane than that of the desk top panel 28, the vertical leg 152 of the bracket 178 is correspondingly shorter. Terminal mounting flanges 184 and 186 at the distal ends of the legs 180 and 182, respectively, abut the interior surfaces of the run-off top panel 32 and side panel 24. Preferably, the terminal flanges extend inwardly at right angles to the respective legs and include longitudinally spaced openings for receipt of screw fasteners 188 which are threaded into suitable holes in the respective panels thereby to secure the bracket to the panels.

For egress of wires to the top surface of the run-off top panel 32, the run-off top panel 32 may include an elongate access opening 192 similar to that in the desk top panel 28 but usually smaller in size. Accordingly, access may be had to the interior of the run-off wiring duct 48 for facilitating the threading of wires therethrough. A closure 194 is provided normally to close the access opening 192. The closure is generally L-shape having a long horizontal leg 196 and short vertical leg 198. The vertical leg 198 extends downwardly and is received in a slot defined by a mounting strip 200 secured to the side panel 24 by fasteners 202. The mounting strip extends the length of the access opening 192 and includes an upwardly extending spaced flange 204 for defining the slot in which the vertical leg 198 of the closure is received. With the shorter vertical leg 198 received in the slot, the longer horizontal leg 196 is of such length to span the access opening 192 so that its distal edge will rest on the top surface of the run-off top panel 32. The closure also includes, as shown in FIG. 1, a number of longitudinally spaced openings of notches 206 therein for passage of wires such as cord 208 of appliance 209 when the closure is in place.

The run-off bracket 178 may extend from the side wiring duct bracket 170 to the inner pedestal wall 42. Such wall may be notched at its upper end as indicated at 190 in FIG. 1 to provide a coaxially aligned opening therein for passage of wires to the interior of the desk pedestal 36. In this manner, wires may be threaded to electrical components housed in the desk pedestal or received from fixtures positioned in the floor beneath the desk pedestal.

The run-off bracket and run-off closure may also take the forms respectively designated generally by reference numerals 210 and 211 in FIG. 5. The run-off bracket 210 which is L-shape in cross-section has vertical leg 212 and horizontal leg 214. The horizontal leg 214 at its distal end may be received in a horizontal groove 216 in the inner face of the side panel 24. The vertical leg 212 has a terminal end flange 218 extending away from the side panel 24 which flange 218 may be received in a horizontal groove 220 in the edge of the run-off top panel 32 defining the longer side of the access opening 192. The bracket 210 should be sufficiently flexible to permit insertion of same in the grooves therefor while being sufficiently rigid to support therein wiring. The run-off closure 211 of FIG. 5 is similar to that of FIG. 4; however, the vertical leg 222 thereof is formed with notches 224 which accommodate the shanks of headed fasteners 226 secured to the side panel 24, the heads of which hold the vertical leg against the side panel 24 with the horizontal leg 228 spanning the access opening 192 in the run-off top panel 32.

It will now be appreciated that a novel desk unit 20 is provided with an interior peripheral wiring duct or ducts for hidden storage of wires or the like. Such desk unit may be readily integrated in modern office systems, such desk unit having provision for receipt of wires or the like from raceways in panels or juxtaposed other units or the like, and/or from the interior of desk such as those wires or the like extending upwardly from the floor receptacles. Access to the interior of the wiring duct may be had through an elongate access opening in the top panel of the desk unit to facilitate threading and handling of the wires or the like in the wiring duct, such access opening, however, normally being closed to provide essentially a continuous, uninterrupted task surface. Moreover, wires may exit from the wiring duct directly to the top surface of the desk unit at locations along the periphery thereof for connection to appliances supported on the desk top through apertures provided in the access opening closure.

Referring now to FIGS. 7–10, it will be appreciated that other types of units may be constructed in accordance with the invention. For example, FIG. 7 shows an enclosure unit 230, FIG.8 shows an L-shape secretarial desk unit 232, FIG. 9 shows a double pedestal desk unit 234 and FIG. 10 shows a credenza unit 236. Each of these units may be provided with full duct wiring management in a manner similar to that shown in FIGS. 1–6. It will be seen that the elements of such other units are of substantially like construction to corresponding elements of the above described desk unit of FIG. 1.

In FIG. 7, the enclosure unit 230 comprises vertical side panels 238 which normally extend from the floor to a substantial height. Secured to the rear vertical edges of the side panels is a rear vertical panel 240. The enclosure unit may also include one or more horizontal shelves or panels 242 mounted between the vertical side panels, at least one of which is preferably positioned at a height corresponding to a customary desk height. The rear edge of the shelf may be spaced from the rear panel 240 so that an elongate access opening 244 is provided to the interior of a wiring duct 246 formed by an L-shape enclosure bracket 248. The L-shape bracket 248 may be secured to the interior surfaces of the shelf and rear panels in a manner similar to that shown in connection with the run-off bracket 178 of the desk unit 20 of FIG. 1. The access opening 244 is normally closed by a closure 250 similar to run-off closure 194. Ingress of wires to the interior of the duct 248 may be provided either by openings 252 in the brackets or through openings 254 in the side panels 238. As shown, the opening 252 in the bracket 248 is in the horizontal leg thereof. Of course, other openings may be provided in the vertical leg. The openings 254 in the side panels are coaxially aligned with the wiring duct 246 and may be provided with snap-in end closures 256 of a type similar to that described above.

FIG. 8 shows another form of desk unit 232 such as may be employed by a secretary. Such desk 232 includes a run-off top panel 258 which is disposed in a lower horizontal plane relative to desk top panel 260 than normally would be provided in an executive desk such as shown in FIG. 1. Other than the run-off top panel 258 being disposed in such lower plane, the desk unit shown in FIG. 8 is substantially of like construction to the desk unit of FIG. 1. If desired, a downwardly extending spacer strip 262 may be secured between the rear edge of the desk top 260 panel and forward edge of the run-off top panel 258.

FIG. 9 shows yet another form of desk unit 234 which is similar to the commonly known two-pedestal desk having pedestals 264 at each side thereof. Such desk includes a front wiring duct 266 and the elements associated therewith are substantially identical to corresponding elements of the desk unit 20 disclosed in FIG. 1.

FIG. 10 shows the credenza 236 including a rear wiring duct 268. The elements of such credenza are substantially identical to corresponding elements of the desk unit 20 shown in FIG. 1.

Although particular preferred embodiments of the invention have been disclosed above for illustrative purposes, it will be understood that variations or modifications thereof which lie within the scope of the appended claims are fully contemplated.

The embodiments of the invention in which an exclusive property or privilege is claimed are defined as follows:

1. A desk or like unit comprising a vertical support panel, a horizontal top panel mounted on and forming a corner with said vertical support panel, and enclosure means secured to said vertical and top panels at said corner for defining with such corner an elongate wiring duct extending parallel to said vertical and top panels, said enclosure means and panels cooperating to form the walls of said wiring duct.

2. The desk unit of claim 1 wherein said enclosure means comprises an L-shape bracket, and said bracket is secured to said panels at the distal ends of the legs thereof.

3. The desk unit of claim 2 wherein said legs of said bracket extend, respectively, parallel to said vertical and top panels thereby forming a wiring duct of rectangular cross-section.

4. The desk unit of claim 2 comprising a mounting flange at the distal end of each leg.

5. The desk unit of claim 4 comprising a mounting strip secured to one of said panels to form a slot therewith, and one of said mounting flanges being received in said slot.

6. The desk unit of claim 5 comprising means for securing the other of said mounting flanges to the other of said panels.

7. The desk unit of claim 2 wherein one of said legs includes an opening therein for passage of wires.

8. The desk unit of claim 1 wherein said top panel projects substantially beyond the outer face of said vertical panel, and said enclosure means comprises a J-shape bracket, said bracket being mounted on said vertical panel at the distal end of the long stem thereof with the short stem abutting the underside of said top panel.

9. The desk unit of claim 8 wherein said short stem is secured to said top panel.

10. A desk or like unit comprising unitary side and front vertical panels and a unitary horizontal top panel therefor, said panels being butted together and joined at their adjacent edges to define a rectilinear desk structure, and means secured to said front panel and said top panel adjacent their butted edges for defining therewith an elongate wiring duct extending between said side panels parallel to said front vertical panel and top panel.

11. The desk unit of claim 10 wherein said side panels include access openings coaxial with the ends of said wire duct.

12. The desk unit of claim 11 wherein said side panels support said top panel along top horizontal edges, and said access openings are in the form of a notch in the top horizontal edge of said side panels.

13. The desk unit of claim 11 comprising a snap-in end closure for each access opening.

14. The desk unit of claim 13 wherein each end closure has at least one notch therein for passage of a wire therethrough.

15. An article of manufacture such as a desk comprising a vertical panel and a horizontal top panel supported thereon at adjacent butted edges, means for forming a horizontal elongate wiring duct adjacent and interiorly of the adjacent butted edges of said vertical and top panels, said top panel including at the butted edge thereof an elongate access opening coextensive with said wiring duct, closure means for said access opening, and wire passage means associated with said closure means for passage of wires therethrough when said closure means is received in said access opening.

16. A desk or the like comprising a desk body including a vertical support panel, a desk top panel mounted on said desk body and supported on said vertical panel at adjacent butted edges, elongate horizontal duct means for passage of wires positioned underneath said desk top panel at the adjacent butted edges of said vertical and desk top panels, said desk top panel including at the butted edge thereof an elongate access opening coextensive with and communicating with said duct means, and elongate cover means normally for closing said access opening.

17. The desk of claim 16 wherein said cover means includes at least one aperture therein for egress of wires from said duct to the top of said top panel.

18. The desk of claim 17 wherein said cover means includes a plurality of apertures spaced longitudinally therealong.

19. The desk of claim 18 wherein said cover means forms a continuation of said top panel when received in said opening.

20. The desk of claim 19 wherein said opening opens to the butted edge of said top panel and said cover means is profiled to simulate said edge.

21. The desk of claim 16 wherein said elongate duct means comprises a bracket for defining with said top and vertical panel an elongate wiring duct.

22. The desk of claim 21 wherein said bracket is L-shape and is secured, respectively, at the distal ends of the legs thereof to said top and vertical panels.

23. The desk of claim 22 comprising a mounting flange at the distal end of each leg.

24. The desk of claim 23 comprising a mounting strip secured to one of said panels to form a slot therewith, and one of said mounting flanges being received in said slot.

25. The desk of claim 24 wherein said cover means is in the form of a thin sheet having a central contoured portion formed to simulate the edge profile of said top panel.

26. The desk of claim 24 wherein said mounting strip is secured to said top panel and forms a second slot therewith, and said cover means has a horizontal flange at one end of said contoured portion receivable in said second slot.

27. The desk of claim 21 wherein said top panel projects substantially beyond the outer face of said vertical panel, and said enclosure means comprises a J-shape bracket, said bracket being mounted on said vertical panel at the distal end of the long stem thereof with the short stem abutting the underside of said top panel.

28. The desk of claim 27 wherein said cover means is in the form of a thin sheet having a central contoured portion formed to simulate the edge profile of said top panel.

29. The desk of claim 28 wherein said short stem of said bracket is secured to the underside of said top panel and clenches said cover means in place.

30. A desk construction comprising a rectilinear desk body and a top panel therefor, a first elongate duct positioned underneath said top panel and extending along one edge thereof, and a second elongate duct positioned underneath said top panel and extending along another edge thereof, said first duct communicating with such second duct and extending at right angles thereto.

31. The construction of claim 30 comprising a run-off for said desk, and a third duct in said run-off communicating with said second duct and forming a continuation thereof.

32. The desk unit of claims 1 or 10 wherein said vertical and top panels are wood panels.

33. A desk or the like comprising a desk body, a desk top panel mounted on said desk body, elongate duct means for passage of wires positioned underneath said desk top panel along one edge thereof, said desk top panel including an elongate access opening communicating with said duct means, elongate cover means normally for closing said access opening, said desk body including a vertical support panel for said desk top panel, said elongate duct means including a bracket for defining with said top and vertical panels an elongate wiring duct, said bracket being L-shape and secured, respectively, at the distal ends of the legs thereof to said top and vertical panels, a mounting flange at the distal end of each leg, a mounting strip secured to one of said panels to form a slot therewith, one of said mounting flanges being received in said slot, said mounting strip being secured to said top panel and forming a second slot therewith, said cover means having a horizontal flange at one end of said contoured portion receivable in said second slot, and a latch member secured to said vertical panel, said cover means having a snap flange at the other end of said contoured portion adapted to interlock with said latch member.

* * * * *